US006878462B1

(12) United States Patent
Umino et al.

(10) Patent No.: US 6,878,462 B1
(45) Date of Patent: Apr. 12, 2005

(54) SURFACE TREATED ZINC-BASED METAL PLATED STEEL SHEET

(75) Inventors: Shigeru Umino, Chiba (JP); Chiyoko Tada, Chiba (JP); Hiroyuki Ogata, Chiba (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 09/857,628

(22) PCT Filed: Oct. 5, 2000

(86) PCT No.: PCT/JP00/06939

§ 371 (c)(1),
(2), (4) Date: Jun. 7, 2001

(87) PCT Pub. No.: WO01/26895

PCT Pub. Date: Apr. 19, 2001

(30) Foreign Application Priority Data

Oct. 8, 1999 (JP) ..... 11-324535

(51) Int. Cl.[7] ..... B32B 15/00; B32B 15/04; B32B 15/08; B32B 15/18

(52) U.S. Cl. ..... 428/628; 428/626; 428/659; 428/681; 428/687; 428/141; 428/336; 428/339; 428/457; 428/469; 428/472; 428/472.1

(58) Field of Search ..... 428/626, 624, 428/628, 615, 658, 659, 681, 687, 88, 141, 195, 220, 336, 339, 457, 469, 475, 471, 472, 472.3, 472.2, 471.1, 649, 704

(56) References Cited

U.S. PATENT DOCUMENTS 4,264,378 A * 4/1981 Oppen et al. ..... 148/6.15 R
4,298,661 A * 11/1981 Ikeno et al. ..... 428/823
5,073,196 A * 12/1991 Fotinos et al. ..... 106/287.19
5,393,611 A * 2/1995 Flamme ..... 428/450
5,646,211 A * 7/1997 Honda et al. ..... 524/406
5,683,816 A 11/1997 Goodreau ..... 428/461
6,096,140 A * 8/2000 Susa et al. ..... 148/253
6,180,177 B1 * 1/2001 Nagashima et al. ..... 427/388.4
6,190,780 B1 * 2/2001 Shoji et al. ..... 428/472
6,235,407 B1 * 5/2001 Ogata et al. ..... 428/626
6,387,538 B1 * 5/2002 Lee et al. ..... 428/632
6,758,916 B1 * 7/2004 McCormick ..... 148/251

FOREIGN PATENT DOCUMENTS

WO WO 93 05198 3/1993
WO WO 99 18256 4/1999

* cited by examiner

*Primary Examiner*—Michael La Villa
(74) *Attorney, Agent, or Firm*—Young & Thompson

(57) ABSTRACT

In the present application, a steel sheet having surface-treated zinc-based plating is provided which comprises a zinc-based plating layer, a chromium-free conductive intermediate layer and an organic resin layer, all of the layers being superimposed one on another in the order mentioned. Even though it is of a so-called chromium-free surface-treated steel sheet, the steel sheet is more conductive and more highly resistant to corrosion than conventional chromium-free steel sheets, the likelihood of water pollution is reduced, and the steel sheet can be used in various applications as a replacement for conventional chromate-treated steel sheets.

4 Claims, 4 Drawing Sheets

60µm

60μm

SURFACE TREATED ZINC-BASED METAL PLATED STEEL SHEET

TECHNICAL FIELD

This invention relates to steel sheets having surface-treated zinc-based plating. More particularly, the invention relates to a steel sheet having surface-treated zinc-based plating that has a chromium-free surface-treated layer, and which has excellent conductivity and corrosion resistance.

BACKGROUND ART

Heretofore, steel sheets having zinc-based plating such as zinc-plated ones and zinc-aluminum-plated ones have found wide applications in industries which produce domestic appliances, automobiles and building materials. Such steel sheets with a chromate coating applied on a plated face, or with an organic layer further disposed on the chromate layer for improving corrosion resistance have been commonly used. When the organic layer is used, the chromate layer performs another role in that it forms a strong bond thereto.

The above-mentioned chromate layer is highly resistant to corrosion and can bond easily to coating compositions. However, this chromate layer has a drawback in that because it contains hexavalent chromium, it is required that an extra draining treatment be performed at the chromate coating step as provided by the Japanese Water Pollution Prevention Law, and consequently, high costs are entailed.

To prevent white rust from developing on steel sheets, zinc based-plated ones in particular, a demand for the development of a technique of surface-treating such steel without the need for chromium has arisen. To this end, a number of proposals as, for instance, the ones described below have been presented.

1. In Japanese Unexamined Patent Application Publication No. 5-195244, a process for surface-treating a metal in which a chromium-free composition is used is proposed. This composition contains (a) an anionic component composed of at least four fluorine atoms and at least one element of titanium and zirconium (fluorotitanic acid, represented as ($TiF_6^{2-}$), for example), (b) a cationic component such as cobalt or magnesium, (c) a free acid for pH adjustment, and (d) an organic resin. However, the surface-treated metal sheet obtained by this process is explicitly stated to exhibit corrosion resistance when such metal sheet is further coated on its upper layer with protective compositions for priming and topcoating as is conventionally practiced. For this reason, the upper layer formed by the surface treatment, when used alone, cannot be said to be sufficiently resistant to corrosion.

2. In Japanese Unexamined Patent Application Publication No. 9-241856, a process for surface-treating a metal in which a chromium-free composition is used is proposed. This composition contains (a) a hydroxyl group-containing copolymer, (b) phosphorus, and (c) phosphates of metals such as copper and cobalt. The surface-treated metal sheet obtained by this process is superior in bare corrosion resistance in as-worked state and an adhesiveness to coatings. On the other hand, there is difficulty in ensuring the conductivity of this metal sheet because it has formed thereon a layer of a dense structure resulting from crosslink between the resin and the different metal phosphates.

3. In Japanese Unexamined Patent Application Publication No. 11-50010, a surface-treating agent for use in a metal is proposed which surface-treating agent is formulated with a chromium-free composition. This composition contains (a) a resin having a polyhydroxy ether segment and a copolymer segment of unsaturated monomers, (b) phosphoric acid, and (c) phosphates of metals such as calcium and cobalt. The surface-treated metal sheet obtained when such an agent is used is superior in bare corrosion resistance, but is not readily conductive because it has formed thereon a dense layer resulting from crosslink of the resin with the different metal phosphates.

4. In Japanese Unexamined Patent Application Publication No. 11-1069450, a water-soluble surface-treating agent is proposed which is prepared by dissolving in an aqueous medium (a) polyvalent metal ions such as of manganese and cobalt, (b) acids such as fluoro acid and phosphoric acid, (c) a silane coupling agent, and (d) a water-soluble polymer with a polymerization unit of 2 to 50. The surface-treated metal material obtained by the use of such an agent is provided thereon with a slightly soluble resin layer disposed to maintain corrosion resistance. To form this resin layer, the metal surface is etched with the aid of the acid components contained in the treating solution. Since the resin layer is composed predominantly of a resin component, conductivity is difficult to attain.

5. In Japanese Unexamined Patent Application Publication No. 11-29724, a process for coating an aqueous rust preventive on zinc-coated steel is proposed. This rust preventive contains (a) a thiocarbonyl group-containing compound, (b) a phosphoric acid ion, and (c) water-dispersible silica. A sulfide such as the thiocarbonyl group-containing compound used in the process of item 5 is, in itself, likely to be easily adsorbed on the surface of a metal such as zinc. In addition, when placed together with a phosphoric acid ion, a thiol group ion of the thiocarbonyl group-containing compound is adsorbed at active sites on the zinc surface during coating of the rust preventive. Thus, rust can be effectively prevented. The zinc-coated steel or non-coated steel obtained by this surface-treating process is highly resistant to corrosion when covered on the surface with a layer structured to have a =N—C (=S)— group or a —O—C (=S)— group, but on the other hand, is not conductive as a whole. If such a layer is made thinner in order to achieve conductivity, portions of the layer, which have not been covered with the thiocarbonyl group-containing compound, appear eventually causing rust. Thus, corrosion resistance and conductivity performance cannot be well balanced even with the process noted here.

In the processes of items 1 to 4 above, corrosion resistance is obtained to a fairly good extent when a sufficient amount, that is, a sufficient thickness of surface-treating agent (a covering agent or a coating agent) is applied to a metal sheet. However, corrosion resistance is extremely low, for example, when the layer is disposed on a metal sheet with nodules which are partly exposed from the layer, or when the layer of the coating formed is too thin. In other words, corrosion resistance is regarded as acceptable only when there is 100% coverage of the metal sheet by the surface-treating agent, but corrosion resistance insufficient when the coverage is less than 100%. In the case of the above-mentioned surface-treating agents, particularly those of items 2 to 4, a dense resin layer is formed by crosslinking a resin and metal salts in order to obtain corrosion resistance. When disposed as a whole to a greater coating thickness, this resin layer becomes less conductive. To enhance conductivity, the coating thickness may be reduced, but this poses a problem in that the resulting resin layer becomes less resistant to corrosion.

Moreover, all the conventional art cited above in items 1 to 5 are based on the conception that a strong bond should be formed at an interfacial boundary between the surface of a metal and the layer to be derived from a surface-treating agent. From a microscopic perspective, the surface-treating agent cannot be completely bonded to the metal surface, and as a result, there is a limit to how much the bondability can be improved. In enhancing corrosion resistance, therefore, the above conventional art focuses on improvements in the denseness of a resin layer to be derived from a surface-treating agent, but not on the bondability between a surface-treating agent and a metal surface. But improved density and improved conductivity are contradictory requirements.

In office appliances such as personal computers and copiers, as well as household appliances such as air conditioners, there has recently been a demand for a surface-treated steel sheet that is not only devoid of chromium and resistant to corrosion, but which has a low surface electrical resistance. The reason for this demand is that steel sheets with low surface electrical resistance, i.e., steel sheets with good conductivity, are effective in preventing the leakage of noise due to electromagnetic waves. Although many proposals for the surface treatment of metals without reliance on chromium are known, none of them discloses a steel sheet having surface-treated zinc-based plating which can meet requirements of both high conductivity and corrosion resistance.

Taking into account the foregoing situation of the known art, the present invention provides a steel sheet having surface-treated zinc-based plating that needs no extra draining treatment at the step in which a surface-treating agent is coated and at the time the resulting steel sheet is put to practical use and has overcome the defects experienced in the known art. In particular, an object of the invention is to provide a steel sheet having zinc-based plating having formed thereon a surface-treated layer, and which has excellent conductivity and corrosion resistance.

DISCLOSURE OF THE INVENTION

In order to achieve the above object, the present inventors have conducted intensive research and have now found that a surface-treated layer can be formed on the surface of a steel sheet having zinc-based plating with no need for chromate coating, which layer is significantly conductive and highly resistant to corrosion. This invention has been made on the basis of this concept.

More specifically, the present invention provides a steel sheet having surface-treated zinc-based plating comprising a zinc-based plating layer, a chromium-free conductive intermediate layer and an organic resin layer, all of the layers being superimposed one on another in the order mentioned.

In the steel sheet having surface-treated zinc-based plating stated above, the intermediate layer preferably comprises at least one acid salt, the acid salt comprising at least one metal selected from the group consisting Cu, Co, Fe, Mn, Sn, V, Mg, Ba, Al, Ca, Sr, Zr, Nb, Y and Zn. In this instance, the acid salt can preferably be derived from at least one acid selected from the group consisting of phosphoric acid, acetic acid, nitric acid and hydrofluoric acid.

In the steel sheet having surface-treated zinc-based plating stated above, the intermediate layer preferably has a coating thickness of 100 nm or more.

In the steel sheet having surface-treated zinc-based plating stated above, the organic resin layer preferably includes at least one metal selected from the group consisting of Cu, Co, Fe, Mn, Sn, V, Mg, Ba, Al, Ca, Sr, Zr, Nb, Y and Zn.

In the steel sheet having surface-treated zinc-based plating stated above, the organic resin layer has a coverage of 10 to 80% with respect to the intermediate layer.

BEST MODE OF CARRYING OUT THE INVENTION

The steel sheet having surface-treated zinc-based plating according to the present invention will now be described in detail.

Steel sheets having zinc-based plating are used in the invention.

The term "zinc-based plating" used herein generically means zinc-containing plating, and hence, this term includes plating with zinc alone, plating with zinc-containing alloys, and plating with zinc-containing composite dispersions. As specific examples of the zinc-based plating, plating with Zn alone; plating with Zn—binary alloys such as plating with a Zn—Ni alloy, plating with a Zn—Fe alloy, plating with a Zn—Cr alloy, plating with a Zn—Co alloy, and plating with a Zn—Al alloy; plating with Zn-ternary alloys such as plating with a Zn—Ni—Cr alloy, and plating with a Zn—Co—Cr alloy; and plating with zinc-containing composite dispersions such as plating with Zn—$SiO_2$, and plating with Zn—Co—Cr—$Al_2O_3$ may be mentioned. Steel sheets treated with such zinc-based plating can be obtained by electric plating or melt plating.

The steel sheet having surface-treated zinc-based plating of the present invention has formed on the surface thereof a chromium-free conductive intermediate layer and an organic resin layer. The intermediate layer is interposed between the steel sheet having zinc-based plating and the resin layer and characterized in that it is resistant to corrosion and is conductive. Here, the term "conductive" denotes a surface resistance of 0.1 mΩ or below as determined by a 4-probe surface resistance meter, e.g., "Roresta AP" manufactured by Mitsubishi Chemical Co.

Figure 1:
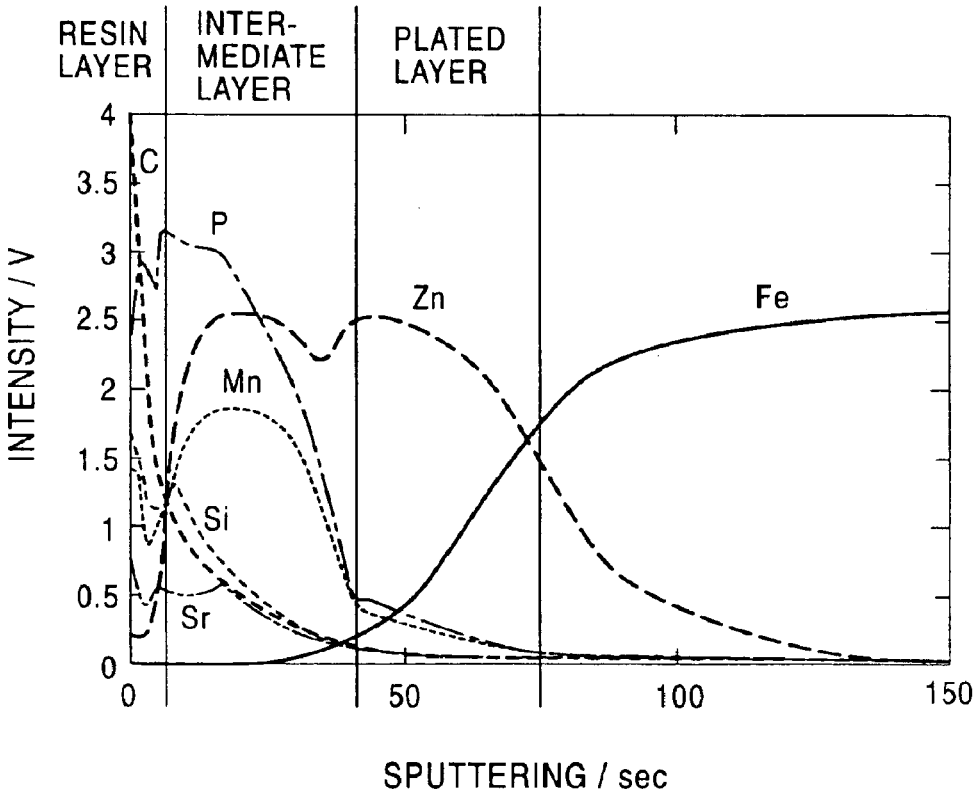
FIG. 1 is a graphic representation illustrating the GDS distributions of the layer components in the steel sheet having surface-treated zinc-based plating according to the present invention.

The presence of the intermediate layer is evidenced in FIG. 1, which illustrates the component distributions in the steel sheet having surface-treated zinc-based plating of this invention when viewed sectionally in the direction of thickness. In FIG. 1, a sputtering time of 0 second refers to the outermost surface. The intermediate layer is composed mainly of metal salts and has a surface resistance of 0.1 mΩ or below and may contain a resin, but to an extent not exceeding 0.1 mΩ. As shown in FIG. 1, Mn, Sr and P, in addition to Zn which constitutes the plating layer are distributed in the intermediate layer. An element C inherent to an organic resin layer is also distributed, though in a limited intensity, in the intermediate layer. Furthermore, C is distributed between the intermediate layer and the outermost surface, which C corresponds to the resin layer.

Thus, in the present invention, it is desired that the concentration of metal salts in the intermediate layer be higher at a region nearer to the lower layer, i.e., the zinc-plated layer, and be lower at a region nearer to the upper layer, i.e., the resin layer. In other words, it is desired that the intermediate layer according to the invention be so structured that metal salts and an organic resin are blended with their respective opposite concentration gradients and that the metal acids should gradually decrease in concentration toward the resin layer, and the organic resin should gradually decrease in concentration toward the zinc-based plating layer.

This is based on the measurement made with RF-GDS 3860 manufactured by Rigaku Co. (under a set of conditions of anode diameter: 4 mmΦ, 20 W and flow rate of Ar gas: 300 cc/min). From the chart thus obtained, the thickness of the intermediate layer can be determined in accordance with the sputtering speed expressed in iron.

The intermediate layer is disposed in the form of a thin layer on the surface of a zinc-based-plated layer by bringing a surface-treating agent into contact with the plated layer surface by using coating, dipping or spraying. The surface-treating agent contains a conductive metal salt other than chromate and an organic resin, and the metal salt reacts with the metal existing in the plated layer and hence forms a strong bond. This is presumably due to the fact that in advance of the organic resin component contained in the surface-treating agent, the dissociated ions of the conductive metal salt could develop ionic bonding to the ions present in the plated layer, thus providing a firmly bonded state.

The coating thickness of the intermediate layer varies depending on the contacting conditions or the kinds of metal salts used, but is preferably in the range of 100 nm and more, more preferably 100 to 500 nm, still more preferably 100 to 200 nm. When the thickness is set to be 100 nm or more, the intermediate layer can be bonded more sufficiently to the zinc-plated layer and also sufficiently resistant to corrosion. As the total content of a metal salt in the intermediate is greater, corrosion resistance and conductivity become favorably higher. However, in the case where the thickness is in excess of 500 nm, the intermediate layer often suffers from ply separation during bending work or the like, resulting in poor bondability. The upper limit of the thickness has thus been specified to be, desirably, at 500 nm.

Figure 2:
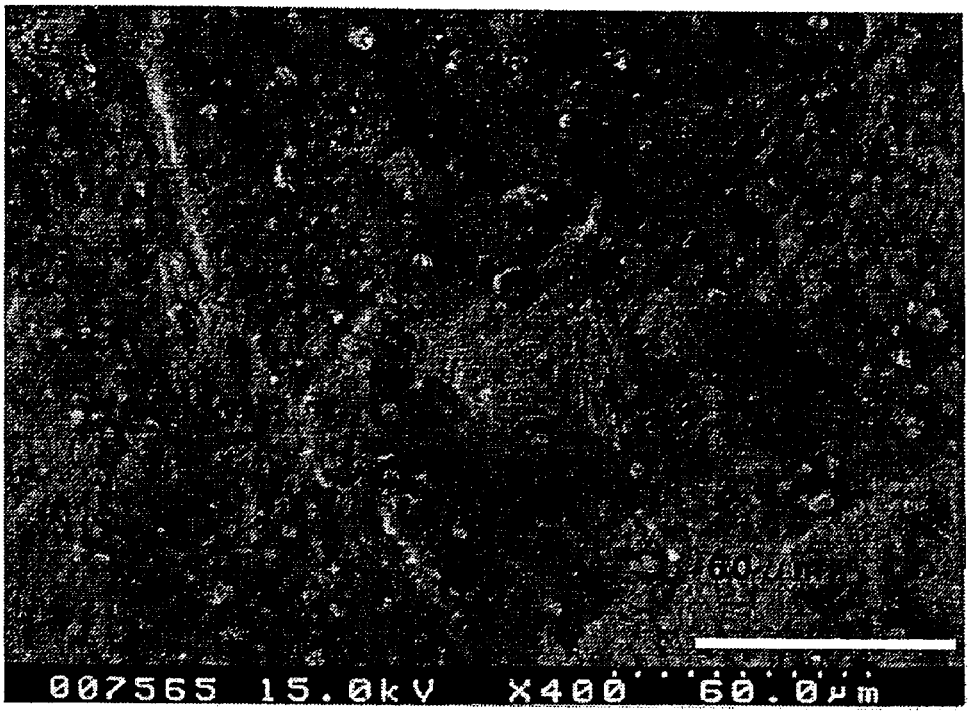
FIG. 2 is a SEM photomicrograph (400-fold magnification) showing one example of the steel sheet having surface-treated zinc-based plating of the invention after having been treated by platinum-palladium deposition.

FIG. 2 is an electron photomicrograph (400-fold magnification), taken by a scanning electron microscope (SEM), which shows an outermost surface of the steel sheet having surface-treated zinc-based plating of the present invention. From the photomicrograph, it can be ascertained that there exists a region in which an intermediate layer only is formed with an organic resin layer not covered. In this invention, the region devoid of the resin layer is considered important. The photomicrograph of FIG. 2 illustrates one of ten random shots taken within the visual field of a photograph with a range of about 220 μm×150 μm. The coverage of an organic resin layer is counted from the area-to-area ratio of covered region to uncovered region in the above photomicrograph.

To form the conductive intermediate layer according to the present invention, certain conductive metal salts are desired. Examples of these metal salts include inorganic acid salts such as of phosphoric acid, nitric acid, carbonic acid and sulfuric acid, and organic acid-salts such as of acetic acid, each such acid salt containing at least one metal selected from the group consisting of Cu, Co, Fe, Mn, Sn, V, Mg, Ba, Al, Ca, Sr, Zr, Nb, Y and Zn. Of these acid salts, a phosphate is preferable. Preferred among these metals is at least one metal selected from the group consisting of Al, Mn and Mg, which metal is converted into a phosphate, a nitrate, a carbonate, a sulfate or an acetate. It is particularly preferable that the three metals, Al, Mn and Mg, in the form of inorganic acid salts, are used in combination. More preferably, an inorganic acid salt of zinc is further combined.

The organic resin layer according to the present invention is disposed to cover the above intermediate layer.

This resin layer is formed on the surface of a zinc-based-plated layer, as described above, by bringing a surface-treating agent into contact with the plated layer surface with the use of coating, dipping or spraying. The surface-treating agent contains a conductive metal salt other than a chromate and an organic resin. Alternatively, the organic resin layer may be formed by first disposing an intermediate layer on the zinc-plated layer and then by contacting an organic resin-containing surface-treating agent with the intermediate layer with use of coating, dipping or spraying.

The total content of a metal salt in the surface-treating agent is preferably in the range of 5 to 60% by weight relative to the solid content of such agent. When a plurality of metal salts is used, the content of each such salt in the surface-treating agent is set to be preferably in the range of 1 to 50% by weight. One % by weight or more ensures sufficient corrosion resistance, whereas greater than 60% by weight does not produce better results but creates cost burdens.

Suitable metal salts to be contained in the surface-treating agent include inorganic acid salts such as of phosphoric acid, nitric acid, carbonic acid and sulfuric acid, and organic acid salts such as of acetic acid, each such acid salt containing at least one metal selected from the group consisting of Cu, Co, Fe, Mn, Sn, V, Mg, Ba, Al, Ca, Sr, Zr, Nb, Y and Zn. Alternatively, a hydroxide of each of the listed metals as a starting material may be reacted in the surface-treating agent with each of the listed acids in a larger amount than the equivalent weight, whereby an acid salt is obtained.

The coating thickness of the organic resin layer is preferably in the range of 0.1 to 2 μm, particularly preferably 0.3 to 0.5 μm. Though effective for further improving corrosion resistance, a thickness exceeding 2 μm is rather uneconomical. Conversely, a thickness of 0.1 μm or more gives corrosion resistance at a sufficient level.

Figure 3:
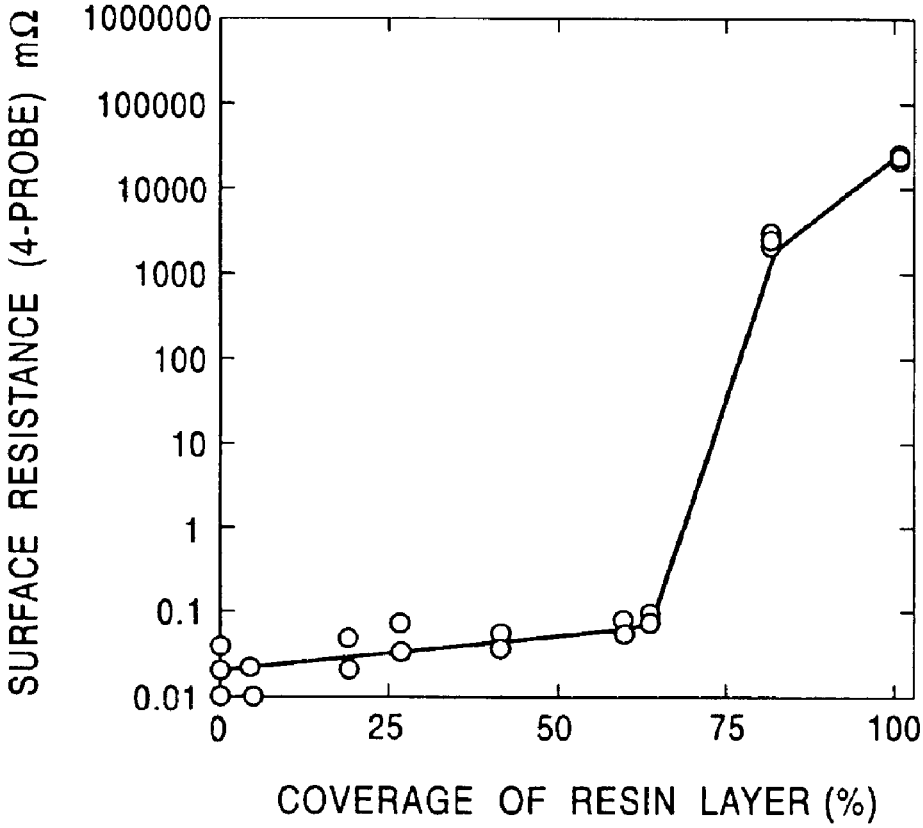
FIG. 3 is a graphic representation showing the relationship between the coverage of and the conductivity of the organic resin layer according to the invention.
Figure 4:
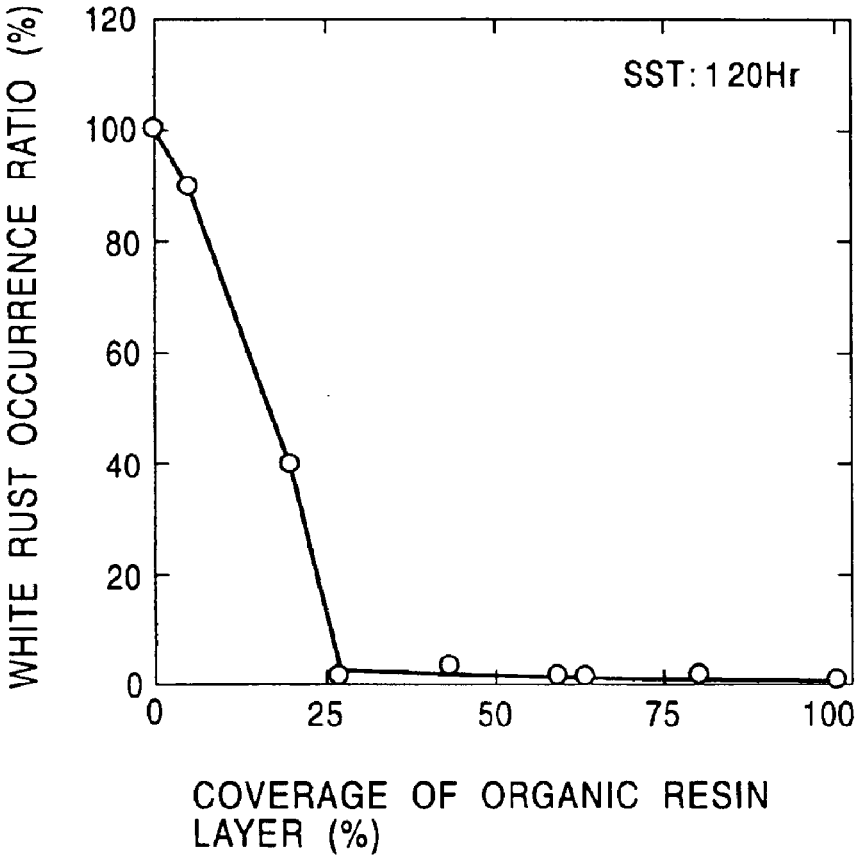
FIG. 4 is a graphic representation showing the relationship between the coverage of and the corrosion resistance of the organic resin layer according to the invention.

In the present invention, the organic resin layer should preferably be arranged such that the intermediate layer formed on the zinc-based plating layer is partly exposed from the outermost surface of such resin layer, but not covered entirely, i.e., a coverage of 100%. This arrangement permits conductivity to be far greater without impairing corrosion resistance. FIG. 3 represents the relationship between the coverage of and the conductivity of the organic resin layer. FIG. 4 represents the relationship between the coverage of and the corrosion resistance (salt spray test: SST, 120 hr) of the organic resin layer. The coverage is preferably in the range of 10 to 80%, particularly preferably 25 to 70%.

The organic resin layer preferably contains a polymer or a copolymer, or both, which will be described later. Examples are illustrated by polymers derived from carboxyl group-containing monomers, and copolymers derived from carboxyl group-containing monomers and other polymerizable monomers, such as copolymers of hydroxyl group-containing monomers and phosphoric acid group-containing monomers.

No particular restriction is imposed on the compositions of the copolymer components. However, in the case of a copolymer of a hydroxyl group-containing monomer and a carboxyl group-containing monomer, the content of the hydroxyl group-containing monomer is preferably in the range of 0.5 to 95.5% by weight, and the content of the carboxyl group-containing monomer is preferably in the range of 0.5 to 95.5% by weight. In the case of a copolymer further including a phosphoric acid group-containing monomer, the content of the hydroxyl group-containing monomer is preferably in the range of 0.5 to 95.4% by weight, the content of the carboxyl group-containing monomer is preferably in the range of 0.5 to 95.4% by weight, and the content of the phosphoric acid group-containing monomer is preferably in the range of 0.1 to 5% by weight.

When the content of the hydroxyl group-containing monomer is 0.5% by weight or more, a functional group is supplemented which contributes to ability of the organic resin layer and the underlying layer to bond to each other, thus dispelling fears corrosion resistance being reduced. On the other hand, 95.5% by weight or less in such monomer content makes the surface-treating agent desirably stable. When the content of the carboxyl group-containing monomer is 0.5% by weight or more, the organic resin layer tends to become dense in structure and hence high in corrosion resistance. Conversely, 95.5% by weight or less in such monomer content favorably prevents a decrease in the amount of a functional group that can more effectively act on carboxyl group-to-carboxyl group association.

When the content of the phosphoric acid group-containing monomer is 5% by weight or less, the surface-treating agent becomes stable. When the content of the phosphoric acid group-containing monomer is 0.1% by weight or more, the density of the organic resin layer increases and hence the corrosion resistance is improved.

The weight-average molecular weight of the copolymer is not particularly restricted, but ranges preferably from ten thousand to about several tens of thousand.

Hydroxyl group-containing monomers eligible for the present invention are reductive hydroxyl group-containing monomers, such as (meth)acrylic acid hydroxyesters, examples of which are hydroxyethyl (meth)acrylate, hydroxypropyl (meth)acrylate, 3-hydroxybutyl (meth) acrylate, 2,2-bis (hydroxymethyl)ethyl acrylate, 2,3-dihyroxypropyl (meth)acrylate and 3-chloro-2-hydroxypropyl (meth)acrylate, allyl alcohols, and hydroxyl group-containing acrylamides, examples of which are N-methylol acrylamide and N-butoxymethylol (meth) acrylamide. Of the listed monomers, 2-hydroxyethyl acrylate and 2-hydroxyethyl methacrylate are more preferable.

Suitable carboxyl group-containing monomers are ethylenically unsaturated carboxylic acids and their derivatives. Examples of the ethylenically unsaturated carboxylic acids are monocarboxylic acids such as acrylic acid, methacrylic acid and crotonic acid, and dicarboxylic acids such as itaconic acid, maleic acid and fumaric acid. The derivatives of these carboxylic acids are typified by alkaline metal salts, ammonium salts and organic amine salts. Specifically, acrylic acid and methacrylic acid are preferred.

Both a water-soluble copolymer derivable from a hydroxyl group-containing monomer and a carboxyl group-containing monomer, and a copolymer derivable from a hydroxyl group-containing monomer and a carboxyl group-containing monomer may be copolymerized with a third polymerizable monomer so long as the characteristics of the organic resin layer can be maintained as desired by the present invention. Suitable third monomers are chosen, for example, from methacrylic acid esters such as styrene, butyl methacrylate and methyl methacrylate.

As suitable copolymers to be contained in the organic resin layer according to this invention, specific examples include acrylic acid polymers, maleic acid polymers, itaconic acid polymers, acrylic acid-maleic acid copolymers, acrylic acid-itaconic acid copolymers and methacrylic acid-maleic acid copolymers.

In the present invention, it is desired that the surface-treating agent further comprise at least one acid selected from the group consisting of phosphoric acid, hydrofluoric acid and hydrogen peroxide, thereby further improving bonding between the intermediate layer and the zinc-based plating layer, preventing separation, and enhancing corrosion resistance. Such an acid is effective for etching the surface of the zinc-based plating layer and forming a strong bond to the intermediate layer. The amount of the acid to be added may be set to be similar to that used in a surface-treating agent or a coating composition for a known surface-treated steel sheet having zinc-based plating. This is sufficient for this invention to achieve various effects as desired.

As the starting material for phosphoric acid useful in the present invention, any compound can be used if it can be converted into phosphoric acid in the surface-treating agent. For example, phosphoric acid-based compounds such as polyphosphoric acid, hypophosphoric acid, tripolyphosphoric acid, hexametaphosphoric acid, primary phosphoric acid, secondary phosphoric acid, tertiary phosphoric acid, polymetaphosphoric acid and biphosphoric acid are shown in addition to phosphoric acid.

In the present invention, it is desired that the surface-treating agent further comprise at least one coupling agent selected from the group consisting of a silane coupling agent, a titanium coupling agent and a zirconium coupling agent, thereby enhancing the bondability between the intermediate layer, the resin layer and the plated layer.

The silane coupling agent is chosen for example from γ-aminopropyltriethoxysilane, γ-aminopropyltrimethoxysilane, N-β-aminoethyl-γ-aminopropyltrimethoxysilane, N-β-aminoethyl-γ-aminopropylmethyldimethoxysilane, γ-glycidoxypropyltrimethoxysilane, γ-glycidoxypropyltriethoxysilane, γ-glycidoxypropylmethyldimethoxysilane, β-3,4-epoxycyclohexylethyltrimethoxysilane, γ-mercaptopropyltrimethoxysilane, γ-methacryloxypropyltrimethoxysilane, γ-methacryloxypropylmethyldimethoxysilane, γ-methacryloxypropyltris(2-methoxyethoxy)silane, vinyltrimethoxysilane, vinyltriethoxysilane, vinyltris(2-methoxyethoxy)silane, vinyltriacetoxysilane, N-[2-(vinylbenzylamino)ethyl]-3-aminopropyltrimethoxysilane and γ-methacryloxypropyltrimethoxysilane.

The titanium coupling agent is chosen for example from diisopropoxy bis(acetylacetona)titanium, dihydroxy bis (lactato)titanium, diisopropoxy bis(2,4-pentadionate) titanium and isopropyl tri(dioctyl phosphate)titanate.

The zirconium coupling agent is chosen for example from acetylacetone zirconium butyrate, zirconium lactate and zirconium acetate.

The amount of each of the above coupling agents to be added may be set to be similar to the amount used in a surface-treating agent or a coating composition for a known surface-treated steel sheet having zinc-based plating. This is sufficient for this invention to achieve various effects as desired.

Preferably, the surface-treating agent further comprises a metal oxide in producing the steel sheet having surface-treated zinc-based plating according to the present invention. This tends to increase the ability of the steel sheet of the invention to bond more firmly to the topcoating usually applied thereto on the part of the user and also to make the intermediate and resin layers denser in structure. As the metal oxide, there is illustrated at least one selected from the group consisting of silica ($SiO_2$), MgO, $ZrO_2$, $Al_2O_3$, $SnO_2$, $Sb_2O_3$, $Fe_2O_3$ and $Fe_3O_4$. Silica is particularly preferred, examples of which are chosen from colloidal silica and gas phase silica. The particle diameter of silica is not restricted, but finer particles are preferable because they mix better with surface-treating components. More preferably, silica may be used together with a silane coupling agent so that synergistic effects can be attained.

The amount of the above metal oxide to be added may likewise be set to be similar to that used in a surface-treating agent or a coating composition for a known steel sheet having zinc-based plating. Desirable effects are sufficiently obtainable.

In the present invention, the surface-treating agent may also be mixed with waxes and various additives used for conventional surface-treating agents, whereby other sorts of performance are imparted to the resulting steel sheet.

In order to produce the steel sheet having surface-treated zinc-based plating of the present invention, a process can be generally employed in which a surface-treating agent is brought into contact with the surface of a steel sheet having zinc-based plating, followed by pressing and drying to form each constituent layer which is then hardened. The surface-treating agent is prepared by dissolving or dispersing the above-specified intermediate layer-forming components and/or the above-specified organic resin layer-forming components in an organic solvent, an inorganic solvent or an aqueous medium. Contacting the surface-treating agent with the steel sheet may be performed by roll coating, spray coating, brush coating, dipping coating or curtain flow coating. The coating or covering amount should be set within the total thickness of the intermediate and resin layers specified above, but the overall coating thickness is preferably in the range of 0.5 to 2.5 μm.

EXAMPLES

The present invention is explained hereinbelow in greater detail with reference to examples.

Inventive Examples 1 to 26, 31 to 57 and 62 to 72 and Comparative Examples 1 to 7

Surface-treating agents were prepared by formulating in water organic resins A to O, additives L to R, metal salts (phosphates, acetates, nitrates, sulfates, carbonates and the like of Al, Mg, Mn, Co and Zn), silica A to C, silane coupling agents A to C and other components, the details of which were indicated below, in accordance with the ratios tabulated in Table 1 to Table 3-2. The surface-treating agents thus obtained were applied by roll coating on to steel sheets having zinc-based plating A to F, the details of which were indicated below. Each such steel sheet was then heated so that there was a temperature rise of 150° C. in 20 seconds, thereby forming a layer with a coating thickness of 0.5 to 2.1 μm amounting to the total thickness of an intermediate layer and an organic resin layer. A specimen was obtained from that layer. The tabulated composition of each surface-treating agent was represented in the order of organic resin/metal salt/silica/silane coupling agent/balance component and by weight ratios. When two or more metal salts were used, the content of each metal salt was made equivalent.

Inventive Examples 27 to 30 and 58 to 61

In the same manner as used in Inventive Examples 1 to 26, 31 to 57 and 62 to 72, an intermediate layer and an organic resin layer were disposed on steel sheet having zinc-based plating A, and this was followed by roll coating of a surface-treating agent containing each of organic resins H to K and water or an organic solvent. Subsequently, the steel sheet was heated so that there was a temperature rise of 150° C. in 20 seconds, thereby forming a layer provided with an upper organic resin layer having a coating thickness of 0.5 μm. A specimen was obtained from that layer.

steel sheets having zinc-based plating A to F

- sheet A: zinc-electroplated steel sheet (sheet thickness: 1.0 mm, Zn: 20 g/m$^2$)
- sheet B: zinc-nickel-electroplated steel sheet (sheet thickness: 1.0 mm, Zn—Ni: 20 g/m$^2$, Ni: 12% by weight)
- sheet C: hot-dipped galvanized steel sheet (sheet thickness: 1.0 mm, Zn: 60 g/m$^2$)
- sheet D: galvannealed steel sheet (sheet thickness: 1.0 mm, Zn: 60 g/m$^2$, Fe: 10% by weight)
- sheet E: zinc-5% aluminum steel sheet ("Galfan", sheet thickness: 1.0 mm, 60 g/m$^2$, Al: 5% by weight)
- sheet F: zinc-55% aluminum steel sheet ("Galvalume", sheet thickness: 1.0 mm, 60 g/m$^2$, Al: 55% by weight).

Organic Resins A to O

The numerical values in resin A to H, L, M and O denote the weight ratios of polymerization units in copolymers.

- resin A: AA/maleic acid=90/10 (molecular weight: 20,000)
- resin B: AA/itaconic acid=70/30 (molecular weight: 15,000)
- resin C: AA/maleic acid=80/20 (molecular weight: 26,000)
- resin D: methacrylic acid/itaconic acid=60/40 (molecular weight: 25,000)
- resin E: styrene/BMA/AA/2HEA/BA=40/10/25/20/2 (molecular weight: 30,000)
- resin F: styrene/BMA/AA/2HEA/2HBA=25/25/25/20/2/2 (molecular weight: 30,000)
- resin G: styrene/BMA/AA/2HEA/BA/2HBA=25/25/20/20/2/2 (molecular weight: 30,000)
- resin H: ethylene/AA=95/5 (molecular weight: 15,000)
- resin I: polyvinyl butyral silicate (molecular weight: 15,000)
- resin J: epoxy-modified urethane resin (molecular weight: 25,000)
- resin K: urethane resin (emulsion)
- resin L: 1-hydroxybutyl acrylate/MMA/BA/styrene/methyl acrylate/organic phosphorus monomer=35/20/30/40/5/1
- resin M: resin resulting from polymerization of a mixture of a bisphenol A type epoxy resin and an unsaturated monomer (styrene/2HEA/methacrylic acid/acrylamide methylpropane sulfonate/dibutyl fumarate/azobisisobutyro nitrile/α-methylstyrene dimer=10/6/8/2/4/2/2) (average molecular weight expressed in polystyrene: 10,000, hydroxyl group: 0.20 equivalent weight/100 g, carboxylic group: 0.34 equivalent weight/100 g, sulfonic acid group: 0.03 equivalent weight/100 g)
- resin N: dimethylaminomethyl-hydroxystyrene polymer
- resin O: polyethylene resin/thiourea=95/5

In the above organic resins, AA denotes acrylic acid, BMA butyl methacrylate, 2HEA 2-hydroxyethyl acrylate, BA butyl acrylate, 2HBA 2-hydroxybutyl acrylate and MMA methyl methacrylate.

Additives additive L: thiourea additive M: 1,3-diethyl-2-thiourea additive N: 2,2'-ditolyl thiourea additive O: 1,3-diphenyl-2-thiourea additive P: thioacetamide additive Q: thioacetaldehyde additive R: thiobenzoic acid.

Silica silica A: colloidal silica ("Snowtex O" manufactured by Nissan Chemical Co.)

silica B: colloidal silica ("Snowtex OL" manufactured by Nissan Chemical Co.)

silica C: gas phase silica ("Aerosil 130" manufactured by Nippon Aerosil Co.)

Silane Coupling Agents silane A: γ-glycydoxypropyl trimethoxy silane ("KBM 403" manufactured by ShinEtsu Chemical Co.)

silane B: "KBM 402" (manufactured by ShinEtsu Chemical Co.)

silane C: "KBM 603" (manufactured by ShinEtsu Chemical Co.)

Metal Salts

P: phosphate

A: acetate

N: nitrate

S: sulfate

C: carbonate.

The following characteristics of each specimen were evaluated (corrosion resistance on flat surface, bondability to topcoating, fingerprinting and conductivity) by the following methods. The presence of each of the intermediate layer and the organic resin layer was determined by GDS and then judged from the profile of the elementary analysis.

Corrosion Resistance on a Planar Surface

The specimen was sheared to a 70 mm×150 mm size, the edges are sealed, and then the specimen was subjected to a salt spray test (Japanese Industrial Standards (JIS) Z-2371). Measurement was made of the time required for white rust to appear on 5% the area of one surface of the specimen. For the evaluation, the following criteria were adopted with the results tabulated in Table 4 to Table 5.

☆: 144 hours or more

◎: 120 hours or more, but less than 144 hours

○: 96 hours or more, but less than 120 hours

Δ: 72 hours or more, but less than 96 hours x: less than 72 hours.

Coat Adhessiveness

As stipulated by JIS K-5400, a melamine-alkyd resin ("Orgaselect 120 White" manufactured by Nippon, Paint Co.) was bar-coated on the specimen to a coating thickness of 20 μm, followed by baking at 135° C. for 15 minutes and subsequent hardening. Thereafter, 100 cuts of 1 mm×1 mm (10×10 cuts) were made which penetrated through the layer on the specimen and reached the substrate steel, and adhesive tape was put on the cuts. Upon peeling from the specimen, the tape was visually inspected to determine the tape surface to which the layer had attached. For the evaluation, the following criteria were adopted with the results tabulated in Table 4 to Table 5.

◎: area of layer release —0%

○: area of layer release—exceeding 0%, but 5% or less

Δ: area of a layer release—exceeding 5%, but 15% or less x: area of layer release—exceeding 15%, but 35% or less xx: area of layer release—exceeding 35%.

Fingerprinting

The variance of color-tones (L value, a value and b value) on the specimen was measured, before and after being coated with vaseline, by use of a spectral differential colorimeter ("SQ 2000" manufactured by Nippon Denshoku Co.). Evaluation was made according to ΔE ($\Delta E=\sqrt{\Delta L^2+\Delta a^2+\Delta b^2}$) with the results tabulated in tabulated in Table 4 to Table 5.

◎: ΔE —1 or less

○: ΔE—more than 1, but 2 or less

Δ: ΔE—more than 2, but 3 or less x: ΔE—more than 3.

Conductivity

The specimen was sheared to a 300 mm×200 mm size. The average surface resistance value was evaluated, after the following ten position coordinates had been corrected, by use of a 4-terminal 4-probe surface resistance meter ("Roresta AP" manufactured by Mitsubishi Chemical Co.). The results are tabulated in Table 4 to Table 5. (50, 30) (50, 90) (60, 150) (50, 210) (50, 270) (150, 30) (150, 90) (150, 150) (150, 210) and (150, 270)

◎: less than 0.1 mΩ

○: 0.1 mΩ or more, but less than 0.5 mΩ

Δ: 0.5 mΩ or more, but less than 1.0 mΩ x: more than 1.0 mΩ.

TABLE 1

| | | Intermediate Layer | | | Organic resin layer | | | | | | Composition of surface-treating agent | |
|---|---|---|---|---|---|---|---|---|---|---|---|---|
| | No. | Metal Sheet | Metal | Coating thickness | Resin | Metal | Silica | Silane coupling agent | Coating thickness | Coverage (%) | Resin/Metal salt/ Silica/Silane coupling agent/ balance (wt %) | Kind of metal salt |
| Inventive Example | 1 | A | Co | 150 nm | B | Co | A | A | 0.4 μm | 50 | 28/22/4/1/45 | acetate |
| | 2 | B | Al | 150 nm | B | Al | A | A | 0.4 μm | 50 | 28/22/4/1/45 | acetate |
| | 3 | C | Al | 150 nm | B | Al | A | A | 0.4 μm | 50 | 28/22/4/1/45 | acetate |
| | 4 | D | Mg | 150 nm | B | Mg | A | A | 0.4 μm | 50 | 28/22/4/1/45 | acetate |
| | 5 | E | Mn | 150 nm | B | Mn | A | A | 0.4 μm | 50 | 28/22/4/1/45 | acetate |
| | 6 | F | Zn | 150 nm | B | Zn | A | A | 0.4 μm | 50 | 28/22/4/1/45 | acetate |
| | 7 | A | Fe | 150 nm | B | Fe | A | A | 0.4 μm | 50 | 30/20/5/2/43 | sulfate |
| | 8 | A | Sn | 150 nm | B | Sn | A | A | 0.4 μm | 50 | 30/20/5/2/43 | sulfate |

TABLE 1-continued

| | Intermediate Layer | | | | Organic resin layer | | | | | | Composition of surface-treating agent | |
|---|---|---|---|---|---|---|---|---|---|---|---|---|
| No. | Metal Sheet | Metal | Coating thickness | Resin | Metal | Silica | Silane coupling agent | Coating thickness | Coverage (%) | Resin/Metal salt/ Silica/Silane coupling agent/ balance (wt %) | Kind of metal salt |
| 9 | A | Mg | 150 nm | B | Mg | A | A | 0.4 μm | 50 | 30/20/5/2/43 | sulfate |
| 10 | A | V | 150 nm | B | V | A | A | 0.4 μm | 50 | 30/20/5/2/43 | sulfate |
| 11 | A | Ba | 150 nm | B | Ba | A | A | 0.4 μm | 50 | 30/20/5/2/43 | sulfate |
| 12 | A | Zn, Mn | 150 nm | B | Zn, Mn | A | A | 0.4 μm | 50 | 25/25/9/1/40 | phosphate |
| 13 | A | Al, Mg | 150 nm | B | Al, Mg | A | A | 0.4 μm | 50 | 25/25/9/1/40 | phosphate |
| 14 | A | Mn, Co | 150 nm | B | Mn, Co | A | A | 0.4 μm | 50 | 25/25/9/1/40 | phosphate |
| 15 | A | Ba, Al | 150 nm | B | Ba, Al | A | A | 0.4 μm | 50 | 25/25/9/1/40 | phosphate |
| 16 | A | Mg, Co | 150 nm | B | Mg, Co | A | A | 0.4 μm | 50 | 25/25/9/1/40 | phosphate |
| 17 | A | Mn | 150 nm | B | Mn | A | A | 0.4 μm | 50 | 20/30/5/3/42 | carbonate |
| 18 | A | Co | 150 nm | B | Co | A | A | 0.4 μm | 50 | 20/30/5/3/42 | carbonate |
| 19 | A | Al, Mg, Mn, Zn | 150 nm | B | Al, Mg, Mn, Zn | A | A | 0.4 μm | 50 | 22/28/33/1/46 | phosphate |
| 20 | A | Al, Mg, Mn, Zn | 150 nm | B | Al, Mg, Mn, Zn | A | A | 0.4 μm | 50 | 22/28/33/1/46 | phosphate |
| 21 | A | Al, Mg, Mn | 150 nm | A | Al, Mg, Mn | A | A | 0 4 μm | 50 | 22/28/33/1/46 | phosphate |
| 22 | A | Al, Mg, Mn | 150 nm | C | Al, Mg, Mn | A | A | 0.4 μm | 50 | 22/28/33/1/46 | phosphate |

TABLE 2

| | | Intermediate Layer | | | | Organic resin layer | | | | | | Composition of surface-treating agent | |
|---|---|---|---|---|---|---|---|---|---|---|---|---|---|
| | No. | Metal Sheet | Metal | Coating thickness | Resin | Metal | Silica | Silane coupling agent | Coating thickness | Coverage (%) | Resin/Metal salt/ Silica/Silane coupling agent/ balance (wt %) | Kind of metal salt |
| Inventive Example | 23 | A | Al, Zn, Sn | 150 nm | D | Al, Zn, Sn | A | A | 0.4 μm | 50 | 28/22/4/1/45 | phosphate |
| | 24 | A | Al, Zn, Sn | 150 nm | E | Al, Zn, Sn | A | A | 0.4 μm | 50 | 28/22/4/1/45 | phosphate |
| | 25 | A | Al, Zn, Sn | 150 nm | F | Al, Zn, Sn | A | A | 0.4 μm | 50 | 28/22/4/1/45 | phosphate |
| | 26 | A | Al, Zn, Sn | 150 nm | G | Al, Zn, Sn | A | A | 0.4 μm | 50 | 28/22/4/1/45 | phosphate |
| | 27*1 | A | Al, Zn, Sn | 200 nm | B | Al, Zn, Sn | A | — | 1.0 μm | 50 | 30/20/3/—/45 | carbonate |
| | 28*2 | A | Al, Zn, Sn | 200 nm | B | Al, Zn, Sn | A | — | 1.0 μm | 50 | 30/20/3/—/45 | carbonate |
| | 29*3 | A | Al, Zn, Sn | 200 nm | B | Al, Zn, Sn | A | — | 1.0 μm | 50 | 30/20/3/—/45 | carbonate |
| | 30*4 | A | Al, Zn, Sn | 200 nm | B | Al, Zn, Sn | A | — | 1.0 μm | 50 | 30/20/3/—/45 | carbonate |
| | 31 | A | Al, Zn, Sn | 200 nm | A | Al, Zn, Sn | A | — | 1.0 μm | 50 | 30/20/3/—/45 | carbonate |
| | 32 | A | Al, Zn, Sn | 200 nm | B | Al, Zn, Sn | A | — | 1.0 μm | 50 | 30/20/3/—/45 | carbonate |
| | 33 | A | Al, Zn, Sn | 200 nm | C | Al, Zn, Sn | A | — | 1.0 μm | 50 | 30/20/3/—/45 | carbonate |
| | 34 | A | Al, Zn, Sn | 200 nm | D | Al, Zn, Sn | A | — | 1.0 μm | 50 | 30/20/3/—/45 | carbonate |
| | 35 | A | Al, Zn, Sn | 200 nm | E | Al, Zn, Sn | A | — | 1.5 μm | 50 | 30/20/3/—/45 | acetate |
| | 36 | A | Al, Zn, Sn | 200 nm | F | Al, Zn, Sn | A | — | 1.5 μm | 50 | 30/20/3/—/45 | acetate |
| | 37 | A | Al, Zn, Sn | 200 nm | G | Al, Zn, Sn | A | — | 1.5 μm | 50 | 30/20/3/—/45 | acetate |
| | 38 | A | Al, Zn, Sn | 200 nm | A | Al, Zn, Sn | A | — | 1.5 μm | 10 | 30/20/3/—/45 | acetate |
| | 39 | A | Al, Zn, Sn | 200 nm | A | Al, Zn, Sn | A | — | 1.5 μm | 30 | 30/20/3/—/45 | acetate |
| | 40 | A | Al, Zn, Sn | 200 nm | A | Al, Zn, Sn | A | — | 1.5 μm | 70 | 30/20/3/—/45 | acetate |
| | 41 | A | Al, Zn, Sn | 200 nm | A | Al, Zn, Sn | A | — | 1.5 μm | 80 | 30/20/3/—/45 | acetate |
| | 42 | A | Al, Zn, Sn | 200 nm | A | Al, Zn, Sn | A | — | 1.5 μm | 5 | 30/20/3/—/45 | acetate |
| | 43 | A | Al, Zn, Sn | 200 nm | A | Al, Zn, Sn | A | — | 1.5 μm | 90 | 30/20/3/—/45 | acetate |
| | 44 | A | Al, Zn, Sn | 200 nm | A | Al, Zn, Sn | A | — | 1.5 μm | 100 | 30/20/3/—/45 | acetate |

*1upper organic layer: Resin H Coating thickness 0.5 μm
*2upper organic layer: Resin I Coating thickness 0.5 μm
*3upper organic layer: Resin J Coating thickness 0.5 μm
*4upper organic layer: Resin K Coating thickness 0.5 μm

TABLE 3-1

| | | | Intermediate Layer | | | Organic resin layer | | | | | | Composition of surface-treating agent | |
|---|---|---|---|---|---|---|---|---|---|---|---|---|---|
| | No. | Metal Sheet | Additive | Metal | Coating thickness | Resin | Metal | Silica | Silane coupling agent | Coating thickness | Coverage (%) | Resin/Metal salt/ Silica/Silane coupling agent/ balance (wt %) | Kind of metal salt |
| Inventive Example | 45 | A | — | Mn, Sn, Mg | 200 nm | A | Mn, Sn, Mg | — | A | 0.3 μm | 50 | 22/28/0/2/48 | phosphate |
| | 46 | A | — | Mn, Sn, Mg | 200 nm | A | Mn, Sn, Mg | B | A | 0.3 μm | 50 | 28/22/5/1/44 | phosphate |
| | 47 | A | — | Mn, Sn, Mg | 200 nm | A | Mn, Sn, Mg | C | A | 0.3 μm | 50 | 28/22/5/1/44 | phosphate |
| | 48 | A | — | Mn, Sn, Mg | 200 nm | A | Mn, Sn, Mg | A | — | 0.3 μm | 50 | 22/28/3/0/47 | phosphate |
| | 49 | A | — | Mn, Sn, Mg | 200 nm | A | Mn, Sn, Mg | A | B | 0.3 μm | 50 | 30/20/5/1/44 | phosphate |
| | 50 | A | — | Mn, Sn, Mg | 200 nm | A | Nn, Sn, Mg | A | C | 0.3 μm | 50 | 30/20/5/1/44 | phosphate |
| | 51 | A | — | Mn, Sn, Mg | 300 nm | A | Mn, Sn, Mg | — | — | 0.4 μm | 50 | 40/35/0/0/25 | carbonate |
| | 52 | A | — | Mn, Sn, Mg | 300 nm | B | Mn, Sn, Mg | — | — | 0.4 μm | 50 | 40/35/0/0/25 | carbonate |
| | 53 | A | — | Mn, Sn, Mg | 300 nm | C | Mn, Sn, Mg | — | — | 0.4 μm | 50 | 40/35/0/0/25 | carbonate |
| | 54 | A | — | Mn, Sn, Mg | 300 nm | D | Mn, Sn, Mg | — | — | 0.4 μm | 50 | 40/35/0/0/25 | carbonate |
| | 55 | A | — | Mn, Sn, Mg | 300 nm | E | Mn, Sn, Mg | — | — | 0.4 μm | 50 | 40/35/0/0/25 | carbonate |
| | 56 | A | — | Mn, Sn, Mg | 300 nm | F | Mn, Sn, Mg | — | — | 0.4 μm | 50 | 40/35/0/0/25 | carbonate |
| | 57 | A | — | Mn, Sn, Mg | 300 nm | G | Mn, Sn, Mg | — | — | 0.4 μm | 50 | 40/35/0/0/25 | carbonate |
| | 58*5 | A | — | Mn, Sn, Mg | 150 nm | B | Mn, Sn, Mg | — | — | 0.5 μm | 50 | 40/35/0/0/25 | carbonate |
| | 59*6 | A | — | Mn, Sn, Mg | 150 nm | B | Mn, Sn, Mg | — | — | 0.5 μm | 50 | 40/35/0/0/25 | carbonate |
| | 60*7 | A | — | Mn, Sn, Mg | 150 nm | B | Mn, Sn, Mg | — | — | 0.5 μm | 90 | 40/35/0/0/25 | carbonate |
| | 61*8 | A | — | Mn, Sn, Mg | 150 nm | B | Mn, Sn, Mg | — | — | 0.5 μm | 90 | 40/35/0/0/25 | carbonate |
| | 62 | A | L | Mn, Sn, Mg | 100 nm | A | Mn, Sn, Mg | A | — | 2 μm | 90 | 28/22/3/0/47 | carbonate |
| | 63 | A | M | Mn, Sn, Mg | 100 nm | A | Mn, Sn, Mg | A | — | 2 μm | 90 | 28/22/3/0/47 | carbonate |
| | 64 | A | N | Mn, Sn, Mg | 100 nm | A | Mn, Sn, Mg | A | — | 2 μm | 90 | 28/22/3/0/47 | carbonate |
| | 65 | A | O | Mn, Sn, Mg | 100 nm | A | Mn, Sn, Mg | A | — | 2 μm | 90 | 28/22/3/0/47 | carbonate |
| | 66 | A | P | Mn, Sn, Mg | 100 nm | A | Mn, Sn, Mg | A | — | 2 μm | 90 | 28/22/3/0/47 | carbonate |
| | 67 | A | Q | Mn, Sn, Mg | 100 nm | A | Mn, Sn, Mg | A | — | 2 μm | 90 | 28/22/3/0/47 | carbonate |
| | 68 | A | R | Mn, Sn, Mg | 100 nm | A | Mn, Sn, Mg | A | A | 2 μm | 90 | 30/20/3/1/46 | carbonate |
| | 69 | A | — | Ca, Cu | 150 nm | B | Ca, Cu | A | A | 0.4 μm | 50 | 30/20/4/1/45 | phosphate |
| | 70 | A | — | Zr, Y | 150 nm | A | Zr, Y | — | A | 0.4 μm | 40 | 35/20/—/1/44 | fluoride |
| | 71 | A | — | Nb, Mn | 150 nm | E | Nb, Mn | — | — | 0.4 μm | 50 | 30/20/—/—/50 | acetic acid |
| | 72 | A | — | Sr, Al | 150 nm | C | Sr, Al | — | — | 0.4 μm | 50 | 30/20/—/—/50 | carbonate |

*5upper organic layer: Resin H Coating thickness 0.5 μm
*6upper organic layer: Resin I Coating thickness 0.5 μm
*7upper organic layer: Resin J Coating thickness 0.5 μm
*8upper organic layer: Resin K Coating thickness 0.5 μm

TABLE 3-2

| | | | Intermediate Layer | | | Organic resin layer | | | | | | Composition of surface-treating agent | |
|---|---|---|---|---|---|---|---|---|---|---|---|---|---|
| | No. | Metal Sheet | Additive | Metal | Coating thickness | Resin | Metal | Silica | Silane coupling agent | Coating thickness | Coverage (%) | Resin/Metal salt/ Silica/Silane coupling agent/ balance (wt %) | Kind of metal salt |
| Comparative Example | 1 | A | — | — | — | B | Mn, Sn, Mg | A | A | 0.5 μm | 50 | 70/—/20/10/— | — |
| | 2 | A | — | — | — | B | Mn, Sn, Mg | A | A | 2 μm | 100 | 70/—/20/10/— | — |
| | 3 | A | — | — | — | — | Co, Zr | — | — | 0.2 μm | 100 | —/17/—/—/83 | Co: carbonate, Zr: fluroide |
| | 4 | A | — | — | — | L | Co | A | — | 0.4 μm | 100 | 80/0.1/6/—/13.9 | phosphate |
| | 5 | B | — | — | — | M | Mn | B | — | 1.0 μm | 100 | 70/10/6/—/14 | phosphate |
| | 6 | A | — | — | — | N | Zn, Zr | — | C | 0.3 μm | 100 | 30/11/—/30/29 | Zn: acetate, Zr: fluoride |
| | 7 | C | — | — | — | O | — | A | — | 1.0 μm | 100 | 20/—/25/—/55 | — |

TABLE 4

| Example | No. | Corrosion Resistance on Flat Surface | Bondability to Topcoating | Finger-printing | Conductivity |
|---|---|---|---|---|---|
| Inventive Example | 1 | ◎ | ◎ | ◎ | ○ |
| | 2 | ◎ | ◎ | ◎ | ○ |
| | 3 | ◎ | ◎ | ◎ | ○ |
| | 4 | ◎ | ◎ | ◎ | ○ |
| | 5 | ◎ | ◎ | ◎ | ○ |
| | 6 | ◎ | ◎ | ◎ | ○ |
| | 7 | ◎ | ◎ | ◎ | ○ |
| | 8 | ◎ | ◎ | ◎ | ◎ |
| | 9 | ◎ | ◎ | ◎ | ◎ |
| | 10 | ◎ | ◎ | ◎ | ◎ |
| | 11 | ◎ | ◎ | ◎ | ◎ |
| | 12 | ◎ | ◎ | ◎ | ◎ |
| | 13 | ◎ | ◎ | ◎ | ◎ |
| | 14 | ◎ | ◎ | ◎ | ◎ |
| | 15 | ◎ | ◎ | ◎ | ◎ |
| | 16 | ◎ | ◎ | ◎ | ◎ |
| | 17 | ◎ | ◎ | ◎ | ◎ |
| | 18 | ◎ | ◎ | ◎ | ◎ |
| | 19 | ◎ | ◎ | ◎ | ◎ |
| | 20 | ◎ | ◎ | ◎ | ◎ |
| | 21 | ◎ | ◎ | ◎ | ◎ |
| | 22 | ◎ | ◎ | ◎ | ◎ |
| | 23 | ◎ | ◎ | ◎ | ◎ |
| | 24 | ◎ | ◎ | ◎ | ◎ |
| | 25 | ◎ | ◎ | ◎ | ◎ |
| | 26 | ◎ | ◎ | ◎ | ◎ |
| | 27 | ◎ | ◎ | ◎ | ◎ |
| | 28 | ◎ | ◎ | ◎ | ◎ |
| | 29 | ◎ | ◎ | ◎ | ◎ |
| | 30 | ◎ | ◎ | ◎ | ◎ |
| | 31 | ◎ | ◎ | ◎ | ◎ |
| | 32 | ◎ | ◎ | ◎ | ◎ |
| | 33 | ◎ | ◎ | ◎ | ◎ |
| | 34 | ◎ | ◎ | ◎ | ◎ |

TABLE 5

| Example | No. | Corrosion Resistance on Flat Surface | Bondability to Topcoating | Finger-printing | Conductivity |
|---|---|---|---|---|---|
| Inventive Example | 35 | ☆ | ◎ | ◎ | ◎ |
| | 36 | ☆ | ◎ | ◎ | ◎ |
| | 37 | ☆ | ◎ | ◎ | ◎ |
| | 38 | ○ | ◎ | Δ | ◎ |
| | 39 | ◎ | ◎ | ○ | ◎ |
| | 40 | ☆ | ◎ | ◎ | ◎ |
| | 41 | ☆ | ◎ | ◎ | ○ |
| | 42 | ○ | ◎ | Δ | ◎ |
| | 43 | ☆ | ◎ | ◎ | Δ |
| | 44 | ☆ | ◎ | ◎ | Δ |
| | 45 | ☆ | ◎ | ◎ | ◎ |
| | 46 | ☆ | ◎ | ◎ | ◎ |
| | 47 | ☆ | ◎ | ◎ | ◎ |
| | 48 | ☆ | ◎ | ◎ | ◎ |
| | 49 | ☆ | ◎ | ◎ | ◎ |
| | 50 | ☆ | ◎ | ◎ | ◎ |
| | 51 | ☆ | ◎ | ◎ | ◎ |
| | 52 | ☆ | ◎ | ◎ | ◎ |
| | 53 | ☆ | ◎ | ◎ | ◎ |
| | 54 | ☆ | ◎ | ◎ | ◎ |
| | 55 | ☆ | ◎ | ◎ | ◎ |
| | 56 | ☆ | ◎ | ◎ | ◎ |
| | 57 | ☆ | ◎ | ◎ | ◎ |

TABLE 5-continued

| Example | No. | Corrosion Resistance on Flat Surface | Bondability to Topcoating | Finger-printing | Conductivity |
|---|---|---|---|---|---|
| | 58 | ☆ | ◎ | ◎ | ◎ |
| | 59 | ☆ | ◎ | ◎ | ◎ |
| | 60 | ☆ | ◎ | ◎ | ◎ |
| | 61 | ☆ | ◎ | ◎ | ◎ |
| | 62 | ☆ | ◎ | ◎ | Δ |
| | 63 | ☆ | ◎ | ◎ | Δ |
| | 64 | ☆ | ◎ | ◎ | Δ |
| | 65 | ☆ | ◎ | ◎ | Δ |
| | 66 | ☆ | ◎ | ◎ | Δ |
| | 67 | ☆ | ◎ | ◎ | Δ |
| | 68 | ☆ | ◎ | ◎ | Δ |
| | 69 | ☆ | ◎ | ◎ | ◎ |
| | 70 | ☆ | ◎ | ◎ | ◎ |
| | 71 | ☆ | ◎ | ◎ | ◎ |
| | 72 | ☆ | ◎ | ◎ | ◎ |
| Comparative Example | 1 | x | ◎ | ◎ | ◎ |
| | 2 | x | ◎ | ◎ | Δ |
| | 3 | x | ◎ | x | ◎ |
| | 4 | ◎ | ◎ | Δ | x |
| | 5 | ◎ | ◎ | Δ | x |
| | 6 | ◎ | ◎ | ○ | x |
| | 7 | x | ◎ | Δ | x |

INDUSTRIAL APPLICABILITY

The steel sheet having surface-treated zinc-based plating according to the present invention is a chromium-free or so-called non-chromate steel sheet. Particularly because of its superiority both in conductivity and in corrosion resistance, this steel sheet can be used as a replacement for chromate-treated steel sheets commonly known in the fields of automobiles, domestic appliances and building materials. As it is free of chromium, the above steel sheet is widely useful for containers, tableware and indoor building materials.

What is claimed is:

1. A steel sheet having surface-treated zinc-based plating comprising a zinc-based plating layer, a chromium-free conductive intermediate layer, containing at least three types of acid salts selected from the group consisting of each of phosphate, nitrate, acetate and fluoride of Al, Mg, Mn, Zn and Sn and an organic resin layer, having the coating thickness of 0.1 to 1.0 $\mu$m, containing the acid salts which are identical with those included in the intermediate layer, wherein all of the layers are superimposed one on another in the order mentioned.

2. A steel sheet having surface-treated zinc-based plating according to claim 1, wherein the intermediate layer has a coating thickness of 100 nm or more.

3. A steel sheet having surface-treated zinc-based plating according to claim 1, wherein the organic resin layer has a coverage of 10 to 80% with respect to the intermediate layer.

4. The steel sheet of claim 1, wherein the chromium-free conductive intermediate layer is also silane-coupling free.

* * * * *